US005407193A

United States Patent [19]

McGinley

[11] Patent Number: 5,407,193

[45] Date of Patent: Apr. 18, 1995

[54] BASEBALL PITCHING TRAINING DEVICE

[76] Inventor: Michael L. McGinley, 9750 Alden, Lenexa, Kans. 66215

[21] Appl. No.: 860,910

[22] Filed: Mar. 31, 1992

Related U.S. Application Data

[63] Continuation of Ser. No. 725,208, Jul. 3, 1991, abandoned.

[51] Int. Cl.[6] ..... A63B 69/40

[52] U.S. Cl. ..... 273/26 R; 273/58 R

[58] Field of Search ..... 273/26 R, 25, 58 R, 273/58 A, 60 R, 60 A, 58 J

[56] References Cited

U.S. PATENT DOCUMENTS 2,263,052 11/1941 Ross ..... 273/63 A
2,925,273 2/1960 Pratt ..... 273/58 A
3,110,494 11/1963 Morgan ..... 273/26 R
4,286,783 9/1981 Newcomb ..... 273/26 R
4,846,471 7/1989 Hayson ..... 273/26 R

*Primary Examiner*—Theatrice Brown
*Attorney, Agent, or Firm*—Richard P. Stitt

[57] ABSTRACT

A baseball pitching training device providing students of pitching with specific finger placement indicia on the cover of a baseball thus allowing the student to precisely emulate the grasp of the baseball utilized by another pitcher. The indicia provide instruction in several different types of pitches for both right handed and left handed students while maintaining the structural integrity of a regulation baseball thus permitting accurate duplication of actual baseball movement.

14 Claims, 1 Drawing Sheet

BASEBALL PITCHING TRAINING DEVICE

This application is a continuation of application Ser. No. 07/725,208, filed Jul. 3, 1991, abandoned.

BACKGROUND OF THE INVENTION

The present invention relates to the field of sports training and more particularly to a baseball pitching training device for use in reproducing the specific pitch finger placement and grasp of the baseball utilized by a particular pitcher.

In the pitching of a baseball the act of pitching is comprised of a number of separate steps during which the pitcher moves from facing forward towards the catcher, to initiating the windup while pivoting to the right or left followed by forward movement and the acceleration of the baseball by the pitcher's arm and concluding with release of the baseball. All of these steps are directed towards the development of acceleration of the baseball towards the catcher. However, while a student of pitching can observe the mechanics of these bodily motions it is difficult if not impossible to observe the particular grasp of the baseball utilized by a pitcher during the course of his pitching. The baseball is covered by both the baseball glove as well as the pitcher's hand and is undergoing rapid movement. This makes it all but impossible to observe particular finger placement by the pitcher. Neither can drawings of the grasping of a baseball by a particular pitcher effectively communicate the actual placement of the fingers on the balls and describe the manner of the overall grip.

While the utilization of a baseball-like structure for communication of the manner of grasping the baseball has been utilized in the past, these have not been regulation type baseball structures. As a result of this deficiency in the prior art, when the ball is actually pitched it cannot perform in the manner of a regulation ball. This is because the structure of the ball has been modified and critical aspects of a regulation baseball are no longer present.

Therefore, it is an object of the present invention to provide a baseball pitching training device which provides the student of pitching with a means for observing the specific placement of the fingers on the baseball and grasp of the baseball as utilized by a particular pitcher.

It is another object of the present invention to provide indicia of finger placement on a single baseball for both left and right handed students of pitching.

It is another object of the present invention to provide a system of presenting finger placement for the pitching of a baseball upon an actual regulation baseball having stitching to effect proper wind resistance characteristics of a pitched baseball.

It is yet another object of the present invention to provide a regulation baseball presenting precise finger positioning for several different pitches on a single ball.

Yet another object of the present invention is to provide a baseball pitching training device which incorporates a regulation baseball and therefore provides the normal action, control and characteristics of a regulation baseball.

Other objects and advantages of this invention will become apparent from the following description taken in connection with the accompanying drawings, wherein is set forth by way of illustration and example, an embodiment of this invention.

Summary of the Invention

The foregoing as well as other objects are satisfied by the invention which provides for a baseball pitching training device which presents on a baseball the finger placement of one pitcher which may then be duplicated by a student of pitching. The training device comprises a baseball cover having a plurality of sets of finger placement indicia on the cover for both left and right handed students. The sets of indicia further comprise a first set of indicia showing the placement of the fingers for throwing a curve ball pitch and a second set of indicia showing the placement of the fingers for throwing a two seam fast ball pitch and a third set of indicia showing the placement of the fingers for throwing a slider pitch and a fourth set of indicia showing the placement of fingers on the ball for throwing a four seam fast ball pitch. To distinguish between the indicia for a left handed pitcher and the indicia for a right handed pitcher the indicia for the left handed pitching student are of a different size than the indicia offered to the right handed pitching student. To distinguish between the indicia for the different pitches the indicia are color-coded such that each color represents a different pitch. To further help the student orient the ball within the hand the indicia are shaped so as to indicate the portion of the indicia which should be closest to the palm of the hand.

DESCRIPTION OF THE PREFERRED EMBODIMENT

Figure 1:
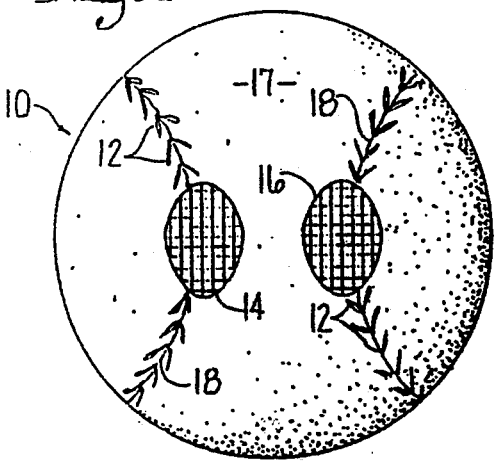
FIG. 1 is a perspective view of the invention illustrating the proper finger placement for left or right handed pitchers for throwing a two seam fast ball.

Referring now to FIG. 1, a regulation baseball 10 is shown having seams 18 of cover 17 closed and held together by stitching 12. This presents the standard regulation baseball construction and is intended so as to provide the necessary look, feel, action, control, and characteristics of the regulation baseball as it is pitched.

It is important to note that the preferred embodiment conforms to the official size and weight requirements of a regulation baseball. It also provides actual stitching 12 of seams 18 of cover 17 such that the ball will react in the fashion of a regulation baseball. This feature is absent from the prior art and is critical to the present invention operating with the actual characteristics of a regulation baseball and thereby overcoming the deficiencies in the prior art of pitching training devices.

Figure 2:
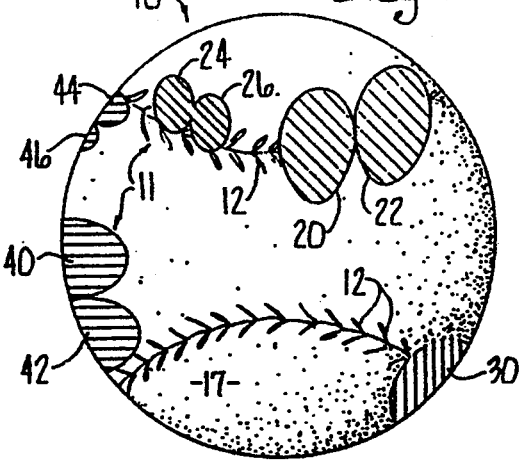
FIG. 2 is a perspective view of the invention illustrating the proper positioning at full scale of finger positions for the throwing of a slider pitch and showing in reduced scale the positioning of fingers for a left handed pitcher for a slider pitch and also showing portions of other finger placement positioning indicia.

Referring now to FIG. 2 multiple finger placement indicia 11 are positioned on cover 17. Indicia 11 are presented in two sizes. The different sizes allow the indicia intended for a left handed student to be easily distinguished from indicia intended for a right handed student. The smaller indicia, exemplified by indicia 24, 26, are intended for the use of a left handed pitcher and the larger indicia, as represented by indicia 20, 22, are intended for the use of a right handed pitcher. In this fashion the two sizes of indicia allow both left handed and right handed pitching students to emulate the proper finger position for the throwing of a particular type of pitch. Indicia 11 are also coded by coloring all indicia which are representative of one type of pitch in one color and indicia representative of another pitch in another color. This color differentiation is represented in the FIGS. 1–5 by the cross hatching marks of the indicia. Indicia having different cross hatchings represent indicia of different coloration and therefore different pitches.

By way of example, the indicia shown in FIG. 1, display both vertical and horizontal cross hatching and would be of like coloration. By contrast, the indicia represented in FIG. 2 have diagonal cross hatching for indicia 24, 26, 20 and 22 and would be of a single color thus indicating a single type of pitch. Also in FIG. 2 and adjacent to indicia 24, 26, 20, 22 are indicia 40, 42, 44, 46 which present only horizontal cross hatching (as reflected in FIG. 4) and therefore would have a different color code in the preferred embodiment.

Referring again to FIG. 1 indicia 14, 16 indicate the positioning for the placement of fingers on the cover for the throwing of a pitch. Indicia 14, 16 present the particular finger positions which allow the throwing of a two seam fast ball. Indicia 14, 16 may be used by either a right handed pitcher or a left handed pitcher as they are symmetrically placed upon the baseball. For a right handed pitcher the index finger of the right hand is placed upon indicia 14 and the middle finger of the right handed pitcher is placed upon indicia 16. The thumb of the pitcher then grasps the ball at a position opposite indicia 14, 16 (FIG. 5) to secure the ball in the hand for the throwing of the two seam fast ball.

In the case of a left handed pitcher the index finger of the left handed pitcher, would be placed upon indicia 16 and the middle finger of the left hand placed upon indicia 14. Again, the thumb would be placed at a convenient position opposite indicia 14, 16 to secure the ball in the hand. When the fingers are placed on the ball in this fashion and the ball is released, the rotation of the ball will be such that the seams of the baseball are generally aligned with the direction of travel except for two portions of the seam on the opposite side of the ball from indicia 14, 16. As a result of this orientation, wind resistance is reduced thus maintaining a high ball velocity.

Referring now to FIG. 2, multiple indicia 11 may be observed on cover 17. Again stitching 12 is present in the preferred embodiment as all finger positions on a regulation baseball are determined relative to the stitching. This determination of finger orientation relative to the stitching is critical as when the baseball achieves high velocities, in the range of 75 to 95 miles per hour the wind resistant characteristics of the seams play a significant role in causing the action of the pitched baseball as it approaches a batter or catcher. Thus it is important that consistent orientation of the seams of the baseball be achieved so as to result in consistency of the pitch which is thrown. By use of the present invention this consistent orientation of the seams may be achieved by the student of pitching as the actual seams of a regulation baseball are present in the preferred embodiment and indicia 11 are correspondingly associated with the seams.

In FIG. 2 indicia are presented for the throwing of a slider ball pitch by both a right handed pitcher and a left handed pitcher. When a right handed pitcher desires to utilize the present invention for learning to throw a slider ball the index finger of the right handed pitcher is placed upon indicia 20 and the middle finger of the right handed pitcher is placed upon indicia 22. The thumb then grasps the ball at a position opposite indicia 20, 22 to secure the ball in the hand.

In a similar manner a left handed pitcher is instructed in the manner of grasping the baseball through the use of indicia 24, 26 for placement of the fingers of the left hand. A left handed pitcher wishing to learn the proper positioning for the throwing of a slider ball would place the index finger of the left hand upon indicia 26 and the middle finger of the left hand upon indicia 24. The thumb of the left hand is then placed on the ball at a position opposite indicia 24, 26 so as to securely hold the ball in the left hand.

Figure 3:
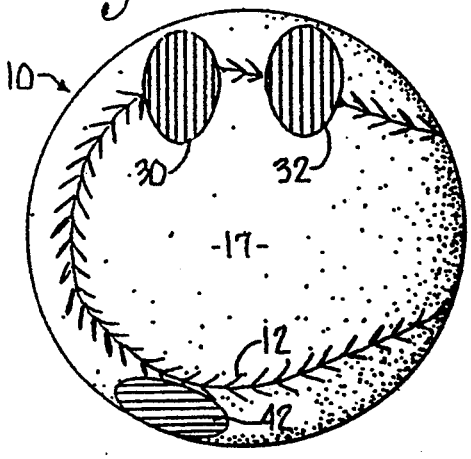
FIG. 3 is a perspective view of the invention of a baseball illustrating the finger placement indicia for the throwing of a four seam fast ball by either left or right handed pitchers.

Referring now to FIG. 3 the method of grasping the ball for pitching a four seam fast ball by either a left handed pitcher or a right handed pitcher is shown. If a right handed pitcher desires to learn the method of throwing a four seam fast ball, the index finger of the right hand is placed upon indicia 30 and the middle finger of the right hand is placed upon indicia 32. The thumb of the right hand securely grasps the ball at a position opposite indicia 30, 32. In this manner when the baseball is thrown four seams of the baseball are oriented perpendicular to the direction of travel and are rotating with the ball. In this fashion the pitch presents a substantially different appearance of the ball as it approaches the batter. Again, it is important to note that indicia 30, 32 are placed with respect to seam 18 and stitching 12 on cover 17 such that the training device looks, feels, and reacts as does a regulation baseball.

Figure 4:
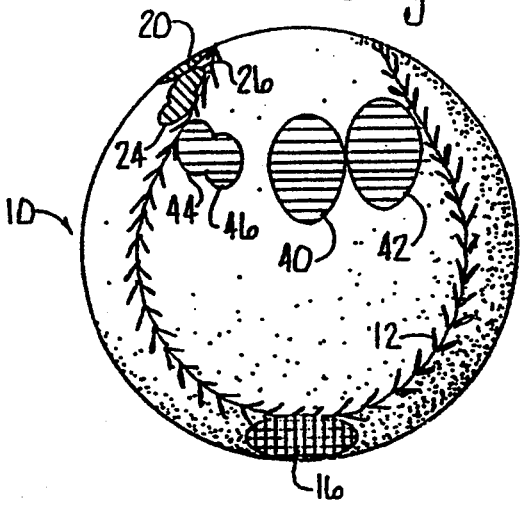
FIG. 4 is a perspective view of the invention of a baseball illustrating the positioning of fingers for the throwing of a curve ball pitch by a right handed pitcher and showing in reduced scale the finger positioning for the throwing of a curve ball pitch by a left handed pitcher.

Referring now to FIG. 4, the indicia on the training device for teaching the fingering position for throwing a curve ball pitch are shown. When a right handed pitcher wishes to learn the method of throwing a curve ball pitch the index finger of the right hand is placed upon indicia 40 and the middle finger of the right hand is placed upon indicia 42. The thumb of the right hand, which acts as a clamp in all pitches to secure the ball within the hand is then placed at a position on the ball opposite indicia 40, 42. When a left handed pitcher wishes to learn the finger placement for the throwing of a curve ball pitch the index finger of the left hand is placed upon indicia 46 and the middle finger of the left hand is placed upon indicia 44. The thumb of the left hand then grasps the baseball at a position on the ball opposite indicia 44, 46.

Figure 5:
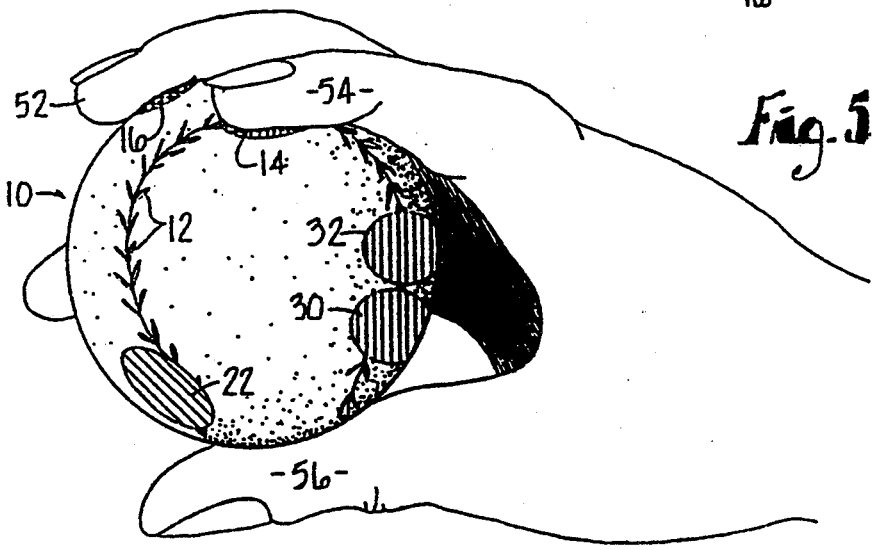
FIG. 5 illustrates the present invention being grasped in the hand of a pitcher for the pitching of a two seam fast ball.

Referring now to FIG. 5 the manner of grasping the pitching instructional device of the present invention is shown. In FIG. 5 the ball is being grasped by a right handed pitcher for the throwing of a two seam fast ball. As explained previously, index finger 54 of the right hand is placed upon indicia 14 and middle finger 52 of the right hand is placed upon indicia 16. Thumb 56, whose sole function is to act as a clamp to secure the ball within the right hand, is placed at a position opposite the index finger and middle finger of the right hand.

It is an important feature of the present invention to provide the student of pitching with accurate finger placement upon a regulation baseball and thereby positioning of the seams in the correct orientation within the hand for creating proper wind resistance when the ball is thrown. This is accomplished through the placement of indicia upon cover 17, which are flush with cover 17 so as not to interfere with the aerodynamics of the baseball. In this manner variability of finger placement is substantially reduced and the student of pitching may concentrate upon the body and arm movement and necessary wrist rotation to provide the correct action upon the pitched baseball.

To further assist the student the indicia are shaped so as to indicate the relationship of the palm of the hand in grasping the ball. The portion of each indicia intended to be situated closest to the palm is slightly tapered thereby to assist the student in achieving correct orientation of the ball in the palm.

It is to be understood that while certain forms of this invention have been illustrated and described, it is not limited thereto, except in so far as such limitations are included in the following claims.

Having thus described the invention, what is claimed as new and desired to be secured by Letters Patent is:

1. A baseball pitching training device for duplicating finger placement on a baseball by a student comprising:
- a baseball cover;
- a plurality of sets of finger placement indicia on said cover, said sets of indicia comprising:
  - a first set of indicia demarcating the placement of finger for throwing a first pitch;
  - a second set of indicia demarcating the placement of fingers for throwing, a second pitch;
  - a third set of indicia demarcating the placement of fingers for throwing a third pitch;
- means for indicating the orientation of the baseball relative to the palm of the hand; and
- means for coding said finger placement indicia sets for identification of each of said indicia associated with any one of said sets.

2. The device as claimed in claim 1 wherein said means for coding comprises a color for association with each indicia of a particular set.

3. The device as claimed in claim 1 wherein said sets of finger placement indicia include indicia sets for left-handed pitching students and indicia sets for right-handed students.

4. The device as claimed in claim 3 further comprising means for identifying said left-handed indicia from said right-handed indicia.

5. The device as claimed in claim 4 wherein said means for identifying comprises differential sizing of said left-handed indicia relative to said right-handed indicia relative to said right-handed indicia.

6. The device as claimed in claim 1, wherein said means for indicating orientation comprises shaping said indicia to distinguish that portion of the baseball to be located proximate to the palm of the hand.

7. The device as claimed in claim 1 wherein said indicia are shaped to indicate a correct orientation of the baseball with respect to the palm of the hand.

8. A baseball pitching training device for duplicating finger placement on a baseball by a student comprising:
- a baseball cover;
- a plurality of sets of finger placement indicia on said cover for both left-handed and right-handed students, said sets of indicia comprising:
  - a first set of indicia demarcating the placement of fingers for throwing a first pitch;
  - a second set of indicia demarcating the placement of fingers for throwing a second pitch;
  - a third set of indicia demarcating the placement of fingers for throwing a third pitch;
- means for identifying said left-handed indicia from said right-handed indicia; and
- means for coding said finger placement indicia sets for identification of each of said indicia associated with said set.

9. The device as claimed in claim 8 wherein said means for coding comprises differential coloring of each of said sets of indicia to identify a fist indicia set from a second indicia set.

10. The device as claimed in claim 8 further comprising means for indicating the orientation of the baseball with respect to the palm of the hand of a student.

11. The device as claimed in claim 10, wherein said means for indicating orientation comprises an asymmetrical indicia shape to distinguish a portion of the baseball to be located proximate to the palm of the hand.

12. The device as claimed in claim 8 wherein said means for identifying comprises differential sizing of said left-handed indicia relative to said right-handed indicia.

13. A baseball pitching training device for instructing a pitching student in finger placement on a baseball comprising:
- a baseball cover;
- a plurality of sets of finger placement indicia on said cover for both left-handed and right-handed students, said indicia sets for left-handed students being differently sized relative to said indicia sets for right-handed students to allow identification thereof, said finger placement indicia comprising:
  - a first set of indicia demarcating the placement of fingers for throwing a first pitch;
  - a second set of indicia demarcating the placement of fingers for throwing a second pitch;
  - a third set of indicia demarcating the placement of fingers for throwing a third pitch;
- each of said indicia sets being differently colored to direct the fingers for both left and right-handed pitchers into place on said cover for the throwing of a particular pitch; and
- means for indicating the orientation of the portion of each indicia of said sets of finger placement indicia which is to be oriented nearest the palm when grasped by a student.

14. The device as claimed in claim 13, wherein said means for orientation comprises shaping said indicia to indicate the correct orientation of the baseball with respect to the palm of the hand.

* * * * *